US010046430B2

(12) United States Patent
Fukui et al.

(10) Patent No.: US 10,046,430 B2
(45) Date of Patent: Aug. 14, 2018

(54) END FACE GRINDING METHOD AND END FACE GRINDING DEVICE

(71) Applicant: NGK INSULATORS, LTD., Nagoya (JP)

(72) Inventors: Toshihiro Fukui, Nagoya (JP); Nobuyuki Umetsu, Nagoya (JP); Nobuchika Noguchi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 30 days.

(21) Appl. No.: 14/989,103

(22) Filed: Jan. 6, 2016

(65) Prior Publication Data

US 2016/0207158 A1 Jul. 21, 2016

(30) Foreign Application Priority Data

Jan. 15, 2015 (JP) ..... 2015-006242

(51) Int. Cl.

| | |
|---|---|
| ***B24B 5/01*** | (2006.01) |
| ***B24B 55/06*** | (2006.01) |
| ***B24B 7/04*** | (2006.01) |
| ***B24B 7/16*** | (2006.01) |
| ***B24B 5/04*** | (2006.01) |

(52) U.S. Cl.
CPC ..... *B24B 5/01* (2013.01); *B24B 5/04* (2013.01); *B24B 7/04* (2013.01); *B24B 7/16* (2013.01); *B24B 55/06* (2013.01)

(58) Field of Classification Search
CPC ..... B24B 5/01; B24B 5/04
USPC ..... 451/28, 41, 57, 456, 450
See application file for complete search history.

(56) References Cited

U.S. PATENT DOCUMENTS 4,158,935 A * 6/1979 Robert ..... B24D 9/08 451/359
4,924,637 A * 5/1990 Ikimi ..... B23P 13/02 451/385
8,210,901 B2 * 7/2012 Kurakake ..... B23P 15/243 451/28

(Continued)

FOREIGN PATENT DOCUMENTS

DE 373548 C 4/1923
EP 0 509 665 A2 10/1992

(Continued)

OTHER PUBLICATIONS

Extended European Search Report (Application No. 16151082.1) dated Jul. 13, 2016.

(Continued)

*Primary Examiner* — Robert Rose
(74) *Attorney, Agent, or Firm* — Burr & Brown, PLLC

(57) ABSTRACT

The end face grinding method includes a structure rotating step of rotating a honeycomb structure based on a rotation axis in a direction orthogonal to the end face of the honeycomb structure, a grinding wheel reverse rotating step of using a grinding wheel disposed so that a grinding surface faces the end face and rotating the grinding wheel in a reverse rotating direction to a rotating direction of the honeycomb structure based on a rotation axis in the direction orthogonal to the end face; and a dry type grinding step of bringing the grinding wheel rotating in the reverse direction close to the rotating honeycomb structure to perform the dry type grinding of the end face.

10 Claims, 3 Drawing Sheets

(56) References Cited

U.S. PATENT DOCUMENTS

| | | | | |
|---|---|---|---|---|
| 2007/0082584 | A1* | 4/2007 | Itoh | B24B 5/04 451/11 |
| 2008/0233345 | A1 | 9/2008 | Allen | |

FOREIGN PATENT DOCUMENTS

| | | | |
|---|---|---|---|
| EP | 1 961 517 | A1 | 8/2008 |
| JP | S58-59765 | | 4/1983 |
| JP | S60-25669 | A1 | 2/1985 |
| JP | 2006-281039 | A1 | 10/2006 |
| JP | 2008-012786 | A1 | 1/2008 |
| JP | 2010-522107 | A | 7/2010 |

OTHER PUBLICATIONS

Japanese Office Action, Japanese Application No. 2015-006242, dated Aug. 22, 2017 (5 pages).
Japanese Office Action (With English Translation), Japanese Application No. 2015-006242, dated Dec. 19, 2017 (9 pages).

* cited by examiner

END FACE GRINDING METHOD AND END FACE GRINDING DEVICE

The present application is an application based on JP 2015-6242 filed on Jan. 15, 2015 with the Japan Patent Office, the entire contents of which are incorporated herein by reference.

BACKGROUND OF THE INVENTION

Field of the Invention

The present invention relates to an end face grinding method and an end face grinding device. More particularly, it relates to an end face grinding method to perform dry type grinding of an end face of a honeycomb structure, and an end face grinding device.

Description of the Related Art

Heretofore, a honeycomb structure made of ceramics (hereinafter simply referred to as "the honeycomb structure") has broadly been used in a use application such as a car exhaust gas purifying catalyst carrier, a diesel particulate removing filter, or a heat reservoir for a burning device. The honeycomb structure is manufactured by preparing a forming material (a kneaded material), extruding the material into a desirable honeycomb shape by use of an extruder, followed by raw cutting, drying and finish-cutting, and then subjecting the material to a firing step of firing the material at a high temperature. The honeycomb structure includes a plurality of polygonal cells defined by latticed cell partition walls.

In the firing step, a honeycomb formed body is mounted on a shelf plate in a state where one end face of the honeycomb formed body is directed downward, and the honeycomb formed body is introduced together with the shelf plate into a firing furnace. At this time, to prevent the honeycomb formed body from being adhered to the shelf plate, a firing support plate called "a setter" is interposed between the shelf plate and the honeycomb formed body. As to this setter, a cut piece of the honeycomb structure obtained by firing the honeycomb formed body is used as the honeycomb formed body firing setter, but when the setter is repeatedly used, chipping occurs. Therefore, a press-molded and fired ceramic raw material called "a pressed setter" is used, and is therefore repeatedly usable. Such setters are generically called "a firing setter". In the present description, the extruded body before fired is called "the honeycomb formed body", and the fired body is called the honeycomb structure.

The extruded honeycomb formed body causes a firing shrinkage along a longitudinal direction of cells and a direction orthogonal to the cell longitudinal direction in the firing step. Consequently, when the honeycomb formed body is mounted on the above firing setter and introduced into the firing furnace, a shift occurs between an upper surface of the firing setter and a lower end face of the honeycomb formed body due to the firing shrinkage of the honeycomb formed body. Therefore, in a case where a partition wall thickness of the honeycomb formed body is small and the body is easy to be deformed or a case where a product diameter of the honeycomb formed body is large and an absolute shrinkage amount due to the firing shrinkage is large, the cell partition walls of the end faces of the honeycomb structure are deformed by the above shift.

Consequently, in a case where the honeycomb formed body including the thin cell partition walls is fired, a raw setter for firing (hereinafter simply referred to as "the raw setter") obtained by slicing an unfired honeycomb formed body made of the same material as in the honeycomb formed body is used in the firing step. As to the raw setter, a firing shrinkage difference between the raw setter and the honeycomb formed body as a firing object is not made during the firing, and the raw setter can cause the firing shrinkage along the longitudinal direction of the cells and a cross sectional direction orthogonal to the longitudinal direction of the cells at the same timing and the same ratio as in the honeycomb formed body.

In consequence, the above shift does not occur between the honeycomb formed body and the raw setter in the firing step, and it is possible to solve problems such as defects of the end face cell partition walls. However, the raw setter can only be used in one firing step, and is disposable. Therefore, as compared with the repeatedly usable firing setter, there is the problem that manufacturing cost of the honeycomb structure increases.

A method is known in which, for the purpose of suitably finishing end faces of a honeycomb formed body, the honeycomb formed body is conveyed between a pair of cup type rotating grinding wheels whose grinding surfaces face each other, along a direction orthogonal to a rotating direction of the cup type grinding wheels, to cut deformed portions of cell partition walls which are generated in the end faces of the honeycomb formed body, followed by firing (see Patent Document 1). Alternatively, for the purpose of removing the deformation of cells and chipping of the partition walls in the end faces which is generated in cutting a raw material, the end faces of a fired honeycomb structure might be ground and processed. A method is known in which a cup type grinding wheel is disposed on each of the end faces of a mounted and fixed honeycomb structure so that a grinding surface of the cup type grinding wheel is substantially parallel to the end face, and the rotating cup type grinding wheel is brought close to the end face at a predetermined grinding wheel feeding speed to grind the end face (see Patent Document 2).

[Patent Document 1] JP-A-2008-12786

[Patent Document 2] JP-A-2006-281039

SUMMARY OF THE INVENTION

However, when a processing method which is disclosed in Patent Document 1 and in which both end faces of a honeycomb formed body are simultaneously ground and processed is applied to a honeycomb structure, a larger force is required for the grinding process of a fired body, and the fired body warps due to shock during the grinding process, thereby generating a defect such as chipping in the end faces. Therefore, it has been difficult to apply this method to the honeycomb structure in which cell partition walls have a small partition wall thickness.

In grinding process of the end faces of a honeycomb structure which is disclosed in Patent Document 2, an operation time to grind the end faces lengthens, and the end faces cannot efficiently be ground. In a case where the end faces of the honeycomb structure are efficiently ground and processed, it is necessary to adjust a moving speed of a grinding wheel to be brought close to the end face (a grinding wheel feeding speed) as fast as possible. However, in a case where the grinding wheel feeding speed is excessively fast, an impact force of the grinding wheel which comes in contact with the end face increases, thereby generating a defect such as chipping of cell partition walls, and a quality of the honeycomb structure deteriorates. On the other hand, in a case where the grinding wheel feeding speed is excessively slow, a processing time required for the grinding of one end face lengthens, the number of grinding process times per unit time decreases, and the grinding process cannot efficiently be performed.

Deformation of the cell partition walls which is caused by shift during a firing shrinkage occurs at a depth of about 0.5 mm from the end face. Therefore, one end face of the honeycomb structure is only ground, and deformed regions of the cells partition walls which are generated by the above shift can be removed. There has been expected an efficient end face grinding method in which a honeycomb formed body is mounted on a firing setter and fired or mounted directly on a shelf plate and fired without using any setters to grind and remove the above deformation of the fired cell partition walls, but manufacturing cost decreases as compared with a case where the honeycomb formed body is mounted on a raw setter and fired.

Furthermore, in a case where dry type grinding of each end face of the honeycomb structure is performed, there is the possibility that ground powder such as dust or powder generated by the grinding process is stuck between a grinding surface of the grinding wheel and the end face of the honeycomb structure and that the ground powder disturbs suitable grinding process of the end face, and it has been expected that the ground powder is effectively removed during the grinding process.

In consequence, the present invention has been developed in view of the abovementioned actual situation of the conventional technology, and an object thereof is to provide an end face grinding method in which grinding process conditions such as a grinding wheel feeding speed and the like to an end face of a honeycomb structure are optimized and grinding process is suitably efficiently performed without chipping of cell partition walls or the like and which is not influenced by ground powder to be generated during the grinding process, and an end face grinding device.

According to the present invention, there are provided an end face grinding method to grind end faces of a honeycomb structure, and an end face grinding device.

[1] An end face grinding method to perform dry type grinding of an end face of a ceramic honeycomb structure, including a structure rotating step of rotating the honeycomb structure based on a rotation axis in a direction orthogonal to the end face; a grinding wheel reverse rotating step of using a grinding wheel disposed so that a grinding surface faces the end face and rotating the grinding wheel in a direction reverse to the rotation of the honeycomb structure based on a rotation axis in the direction orthogonal to the end face; and a dry type grinding step of bringing the grinding wheel rotating in the reverse direction close to the rotating honeycomb structure to perform the dry type grinding of the end face.

[2] The end face grinding method according to the above [1], further including a dust collecting step of sucking, from the side of the grinding surface, ground powder of the honeycomb structure which is generated by the dry type grinding step to collect dust.

[3] The end face grinding method according to the above [2], wherein in the grinding wheel reverse rotating step, a hollow tubular spindle to rotate the grinding wheel is used, and in the dust collecting step, the ground powder is sucked from one end of the spindle which is open to the grinding surface.

[4] The end face grinding method according to any one of the above [1] to [3], wherein the honeycomb structure includes a plurality of polygonal cells defined by latticed cell partition walls, and a relation between a grinding wheel feeding speed Y (mm/min) of the grinding wheel to the honeycomb structure in the dry type grinding step and a partition wall thickness X (mm) of the cell partition walls satisfies conditions of $Y \leq 114.7X-1.78$.

[5] The end face grinding method according to any one of the above [1] to [4], wherein a peripheral speed of the grinding wheel in the grinding wheel reverse rotating step is 35 m/s or more.

[6] The end face grinding method according to any one of the above [1] to [5], wherein a rotating speed of the honeycomb structure in the structure rotating step is 50 rpm or more and 600 rpm or less.

[7] The end face grinding method according to any one of the above [1] to [6], wherein a grinding depth of the end face of the honeycomb structure in the dry type grinding step is from 0.5 to 1.0 mm.

[8] An end face grinding device to perform dry type grinding of an end face of a ceramic honeycomb structure by use of the end face grinding method according to any one of the above [1] to [7], including a structure rotating mechanism section which has a rotating portion including a structure holding portion holding the honeycomb structure and which rotates the honeycomb structure based on a rotation axis in a direction orthogonal to the end face; a grinding wheel reverse rotating mechanism section which has a grinding wheel supporting portion supporting a grinding wheel whose grinding surface is disposed to face the end face and which rotates the grinding wheel in a direction reverse to a rotating direction of the honeycomb structure based on a rotation axis in a direction orthogonal to the end face and the grinding surface; and a dry type grinding mechanism section which brings the grinding wheel rotating in the reverse direction close to the rotating honeycomb structure to perform the dry type grinding step of the end face.

[9] The end face grinding device according to the above [8], further including a dust collecting mechanism section which sucks, from the side of the grinding surface, ground powder of the honeycomb structure which is generated by the dry type grinding of the end face, to collect dust.

[10] The end face grinding device according to the above [9], wherein the grinding wheel reverse rotating mechanism section further includes a hollow tubular spindle connected to the grinding wheel supporting portion to rotate the grinding wheel, and the dust collecting mechanism section sucks the ground powder from one end of the spindle which is open to the grinding surface side, to collect the dust.

According to an end face grinding method and an end face grinding device of the present invention, a grinding wheel is rotated in a direction reverse to a rotating direction of a honeycomb structure to perform grinding process of each of the end faces, so that the end face of the honeycomb structure can be finished without causing a quality defect such as chipping in the end face, even when the honeycomb structure has a small partition wall thickness of cell partition walls.

DESCRIPTION OF THE PREFERRED EMBODIMENTS

Hereinafter, embodiments of an end face grinding method and an end face grinding device of the present invention will be described with reference to the drawings, respectively. The present invention is not limited to the following embodiments, and changes, modifications, improvements and the like can be added without departing from the gist of the present invention.

Figure 1:
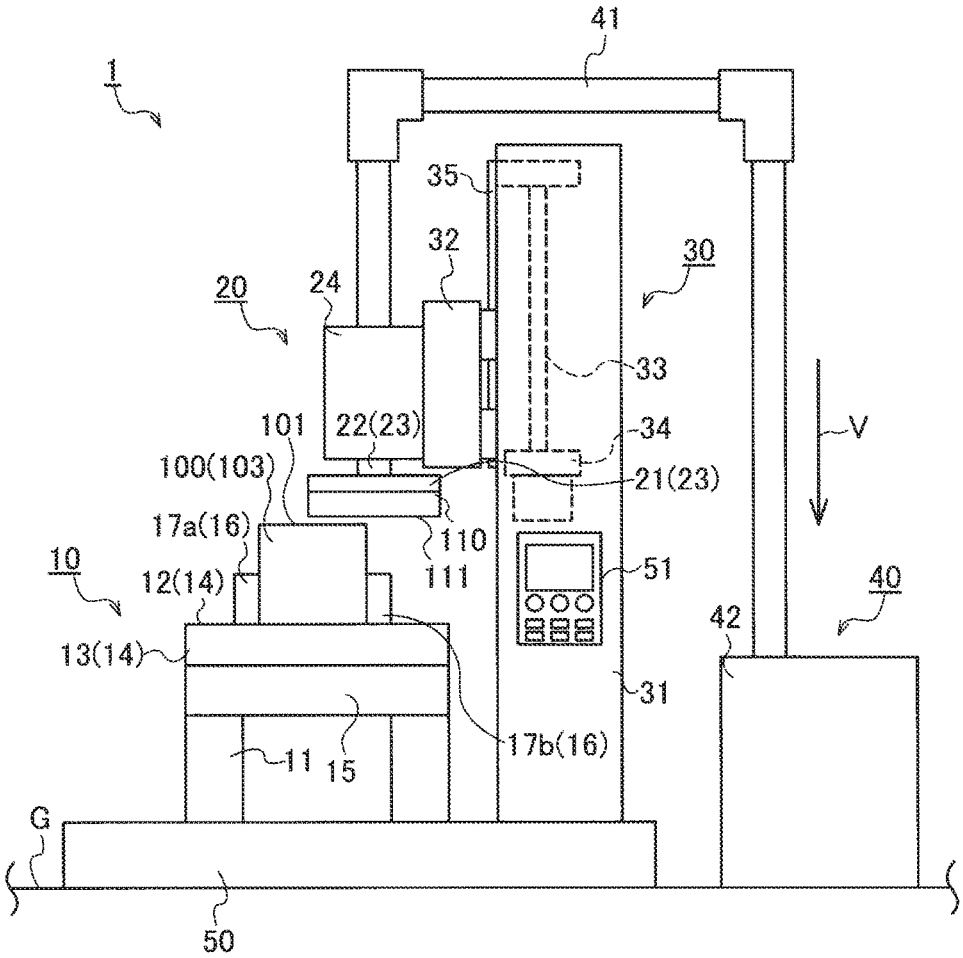
FIG. 1 is an explanatory view schematically showing a schematic constitution of an end face grinding device of the present embodiment.
Figure 2:
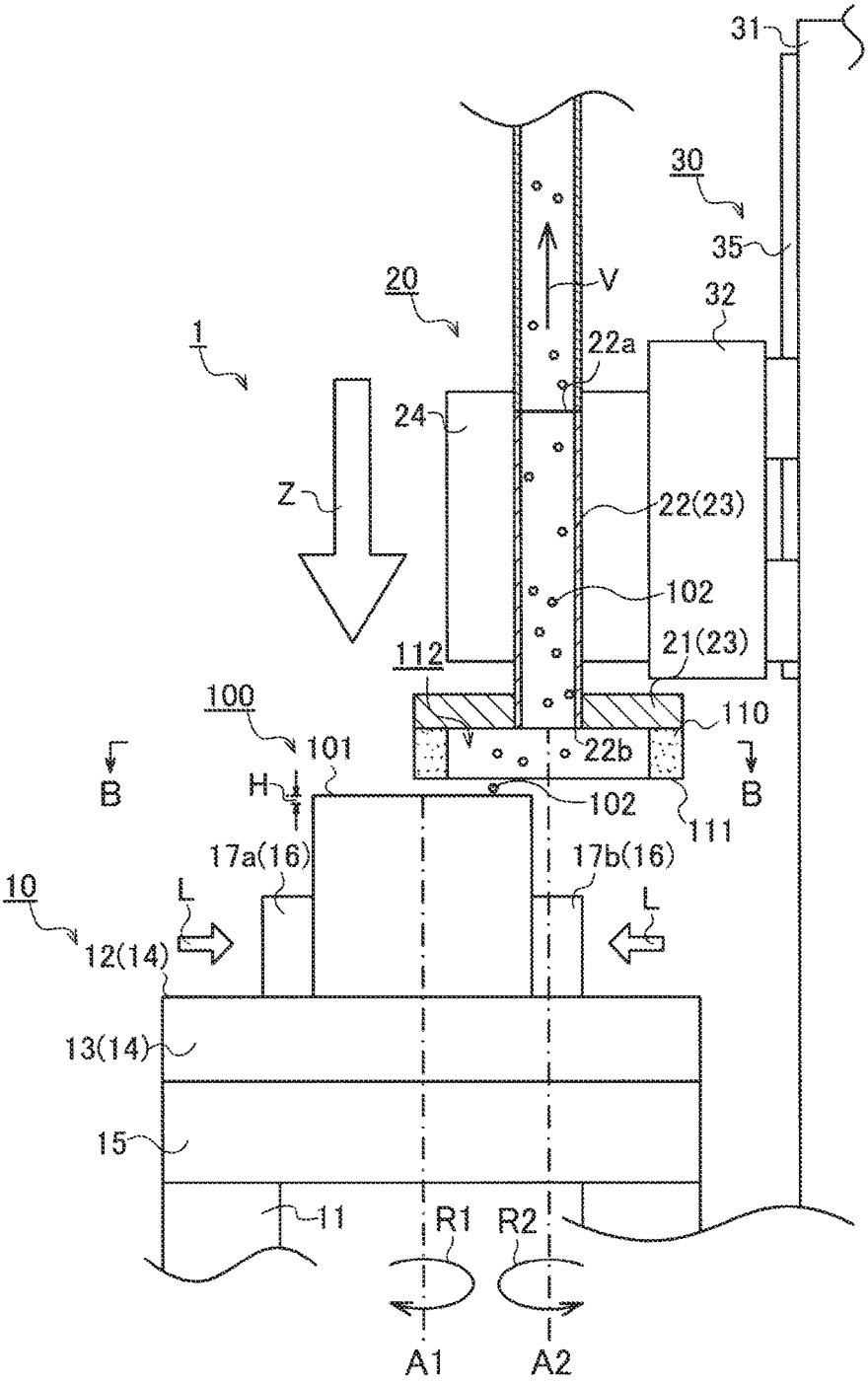
FIG. 2 is a partially enlarged explanatory view schematically showing the schematic constitution of the end face grinding device.
Figure 3:
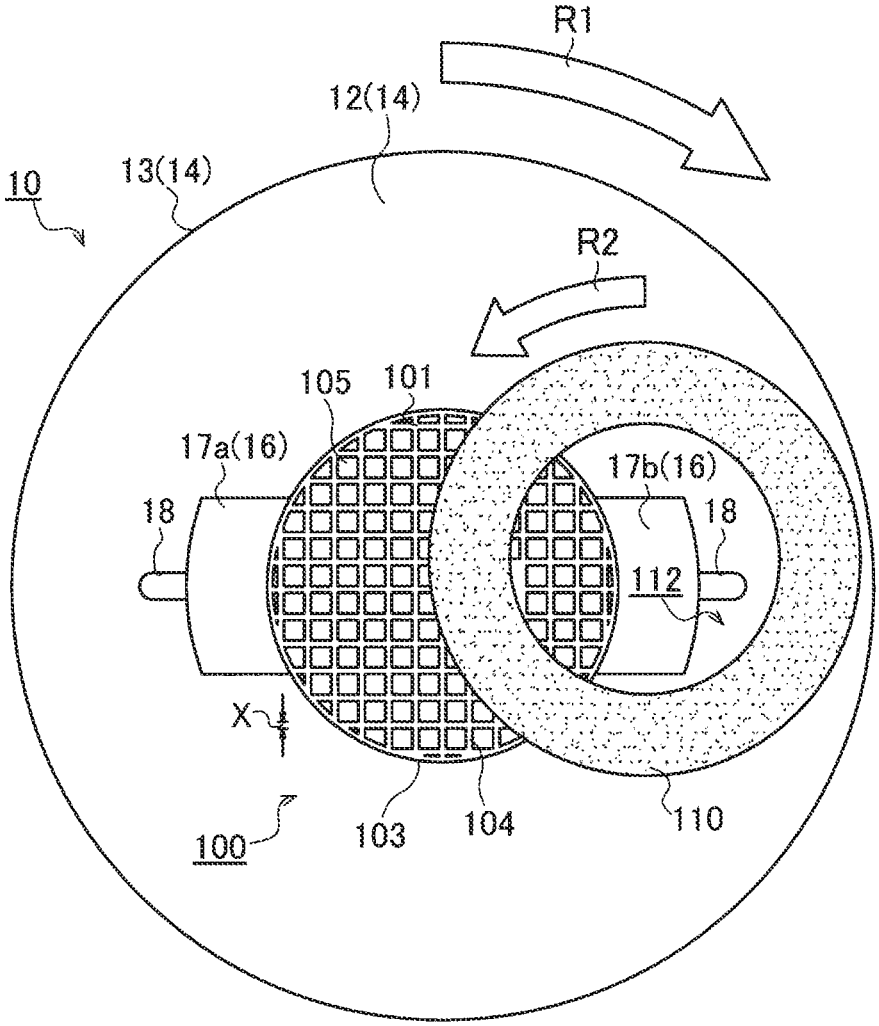
FIG. 3 is a schematic cross-sectional view taken along the B-B line of FIG. 2 and schematically showing a relation between an end face of a honeycomb structure and a grinding surface of a grinding wheel.

As shown in FIG. 1 to FIG. 3, an end face grinding device 1 of one embodiment of the present invention includes a structure rotating mechanism section 10 to rotate a ceramic honeycomb structure 100 including a plurality of polygonal cells 105 defined by latticed cell partition walls 104 in a predetermined rotating direction R1 based on a rotation axis A1 in a direction orthogonal to an end face 101, a grinding wheel reverse rotating mechanism section 20 to rotate a grinding wheel 110 in a reverse direction (a reverse rotating direction R2) to the rotation of the honeycomb structure 100, and a dry type grinding mechanism section 30 to bring a grinding surface 111 of the grinding wheel 110 close to the end face 101 of the honeycomb structure 100 and to perform dry type grinding of the end face 101. Furthermore, the end face grinding device 1 of the present embodiment has a dust collecting mechanism section 40 which sucks ground powder 102 as shavings of the honeycomb structure 100 which is generated during the dry type grinding, from a grinding surface 111 side of the grinding wheel 110, to collect dust. In the end face grinding device 1 of the present embodiment, there is used the heretofore well-known grinding wheel 110 in the form of a cup which has the grinding surface 111 in the vicinity of a circumference and in which a cavity 112 is formed in a central portion.

The structure rotating mechanism section 10 has a structure supporting portion 11 attached onto a common base 50 substantially in the form of a flat plate mounted on an installation surface G on which the end face grinding device 1 is installed, a structure rotating substrate 14 having a disc-like rotating portion 13 rotatably supported on an upper surface of the structure supporting portion 11 and including a structure fixing surface 12 to fix the honeycomb structure 100 in a vertically standing manner, and a structure driving portion 15 such as a motor which is connected to the rotating portion 13 and generates a rotary driving force to rotate the rotating portion 13 and the honeycomb structure 100 in the predetermined rotating direction R1 based on the rotation axis A1 in the direction orthogonal to the end face 101 of the honeycomb structure 100.

Furthermore, on the structure fixing surface 12 of the rotating portion 13, there is installed a structure holding portion 16 which securely holds the honeycomb structure 100 in the rotating portion 13 to prevent the honeycomb structure 100 from being moved horizontally along the structure fixing surface 12 during the rotation and from falling from the vertically standing manner. The structure holding portion 16 has a pair of fixing chucks 17*a* and 17*b* having an inner peripheral shape matching a curved surface shape of a circumferential side surface 103 of the honeycomb structure 100, and a moving groove 18 to move the fixing chucks 17*a* and 17*b* in a horizontal direction along the structure fixing surface 12. As shown in FIG. 3, inner peripheral surfaces of the fixing chucks 17*a* and 17*b* abut on the circumferential side surface 103 of the honeycomb structure 100, and the circumferential side surface is held to be sandwiched from both directions (see a holding direction L in FIG. 2). In consequence, the moving, falling or the like of the honeycomb structure 100 is not caused by the rotation of the rotating portion 13.

According to the constitution of the structure rotating mechanism section 10, the rotating portion 13 and the honeycomb structure 100 held by this rotating portion can be cooperated and rotated along the rotation axis A1. It is to be noted that a rotating speed of the honeycomb structure 100 (a rotating speed of the rotating portion 13) is set to 50 rpm or more and be smaller than 600 rpm in the end face grinding device 1 of the present embodiment. Here, the honeycomb structure 100 is fixed so that a center of the end face 101 matches the rotation axis A1. It is to be noted that in a case where the rotating speed of the honeycomb structure 100 is set to 600 rpm or more, the structure rotating mechanism section 10 cannot stably hold the honeycomb structure 100.

The grinding wheel reverse rotating mechanism section 20 has a grinding wheel rotating substrate 23 including a grinding wheel supporting portion 21 substantially in the form of a disc to support the cup-shaped grinding wheel 110 in which the grinding surface 111 is disposed to face the end face 101 of the honeycomb structure 100 held by the rotating portion 13, and a hollow tubular spindle 22 (a rotary shaft portion) suspended from a center of one surface of the grinding wheel supporting portion 21; and a grinding wheel driving portion 24 such as a motor which is connected to the spindle 22 and generates the rotary driving force to rotate the grinding wheel supporting portion 21 and the grinding wheel 110 in the reverse rotating direction R2 to the rotating direction R1 of the honeycomb structure 100, based on a rotation axis A2 in the direction orthogonal to the end face 101.

According to the constitution of the grinding wheel reverse rotating mechanism section 20, along the rotation axis A2, the grinding wheel supporting portion 21 and the grinding wheel 110 held by this grinding wheel supporting portion can be cooperated and rotated in the reverse direction to the rotation of the honeycomb structure 100. It is to be noted that a rotating speed (a peripheral speed) of the grinding wheel 110 is set to 35 m/s or more in the end face grinding device 1 of the present embodiment. Additionally, an upper limit value of the peripheral speed of the grinding wheel 110 in the end face grinding device 1 for safety is 60 m/s. Therefore, the rotating speed of the grinding wheel 110 is set to a range of 35 to 60 m/s.

The rotation axis A1 of the honeycomb structure 100 and the rotation axis A2 of the grinding wheel 110 match each other in an axial direction and are disposed away from each other in parallel with each other. Furthermore, the grinding surface 111 of the grinding wheel 110 is disposed to cover at least a radial direction of the end face 101 of the honeycomb structure 100 (see FIG. 3). Consequently, the honeycomb structure 100 and the grinding wheel 110 are rotated, respectively, whereby the end face 101 abuts on at least a part of the grinding surface 111 of the grinding wheel 110. In consequence, it is possible to perform the dry type grinding along the whole end face 101 by the grinding wheel 110.

The dry type grinding mechanism section 30 gradually brings the grinding wheel 110 rotating in the reverse rotating direction R2 (e.g., a counterclockwise direction) to the honeycomb structure 100 rotating in the predetermined rotating direction R1 (e.g., a clockwise direction) at the predetermined grinding wheel feeding speed Y, thereby bringing the grinding surface 111 of the grinding wheel 110 into contact with the end face 101 of the honeycomb structure 100, to cut and remove the end face 101 of the honeycomb structure 100 by the grinding surface 111.

As a specific constitution, the dry type grinding mechanism section 30 includes a sliding supporting portion 31 installed adjacent to the structure rotating mechanism section 10 and installed in a standing manner from the common base 50, and a sliding portion main body 32 which is projected from the sliding supporting portion 31 toward a structure rotating mechanism section 10 side and is slidable to the sliding supporting portion 31 along a predetermined sliding direction. Here, in the end face grinding device 1 of the present embodiment, the sliding direction of the sliding portion main body 32 matches a perpendicular direction orthogonal to the installation surface G.

Furthermore, the sliding portion main body 32 is connected to a sliding driving portion 34 such as a servo motor connected to one end of a ball screw 33 to axially rotate the ball screw 33, via the ball screw 33 installed in the sliding supporting portion 31, and is supported by a sliding rail 35 installed on an outer wall surface of the sliding supporting portion 31 along the sliding direction. When such a constitution is employed, the ball screw 33 axially rotates by driving of the sliding driving portion 34, and further, in accordance with this axial rotation, the sliding portion main body 32 slides (rises and lowers) in an upward-downward direction along the sliding rail 35.

The grinding wheel reverse rotating mechanism section 20 mentioned above is installed in the sliding portion main body 32. Consequently, the grinding wheel 110 supported by the grinding wheel reverse rotating mechanism section 20 can slide in a grinding wheel feeding direction Z to come close to the end face 101 of the honeycomb structure 100 by the dry type grinding mechanism section 30, while rotating in the reverse rotating direction R2 by the grinding wheel reverse rotating mechanism section 20. In the end face grinding device 1 of the present embodiment, constitutions of the ball screw 33, the sliding rail 35 and the like are employed, and hence the sliding portion main body 32 can smoothly be slid to the sliding supporting portion 31 at the preset grinding wheel feeding speed Y without causing any vibration or the like.

The end face grinding device 1 of the present embodiment has the structure rotating mechanism section 10, the grinding wheel reverse rotating mechanism section 20, the dry type grinding mechanism section 30, and an operation control section 51 electrically connected to these sections. In consequence, via the operation control section 51, it is possible to execute grinding process conditions programmed in advance, and it is possible to perform control or the like of operation start and operation stop timings of the structure driving portion 15, the grinding wheel driving portion 24 and the sliding driving portion 34, and rotation numbers of the honeycomb structure 100, the grinding wheel 110 and the ball screw 33.

A grinding depth H (a grinding amount) of the end face 101 by use of the grinding wheel 110 in the dry type grinding mechanism section 30 is set to a range of 0.5 to 1.0 mm. Here, deformation of the cell partition walls 104 based on shift due to firing shrinkage mostly occurs at a depth of about 0.5 mm from an upper end of the end face 101 as described above. The grinding depth H is in the above numeric range, so that the deformation of the cell partition walls 104 can substantially securely be removed. On the other hand, in a case where the grinding depth H is in excess of 1.0 mm, processing time lengthens, and grinding process cannot efficiently be performed. Furthermore, non-deformed portions of the cell partition walls 104 which do not have to be removed are disadvantageously removed, and there is also the possibility of increase of manufacturing cost.

In the end face grinding device 1 of the present embodiment, a relation between a grinding wheel feeding speed Y (mm/min) of the grinding wheel 110 to the end face 101 in the grinding wheel feeding direction Z and a partition wall thickness X (mm) of the cell partition walls 104 of the honeycomb structure 100 as a grinding object is set to satisfy an upper limit of Equation (1) mentioned below:

$$Y \leq 114.7X - 1.78 \quad (1).$$

That is, a value of the grinding wheel feeding speed Y is set to be the same value as or a value below a value calculated on the basis of the partition wall thickness X. Conditions of Equation (1) mentioned above are satisfied, and hence it is possible to decrease shock when the grinding wheel 110 comes in contact with the honeycomb structure 100. Especially, in a case where the partition wall thickness X of the cell partition walls 104 is small, when the shock of the contact is large, there is a high possibility that chipping or the like occurs in the end face 101 of the honeycomb structure 100. Therefore, the grinding wheel feeding speed Y is suppressed to the value or less obtained by applying Equation (1), to decrease an influence of damages due to the shock, and the occurrence of the chipping of the cell partition walls 104 decreases.

In the end face grinding device 1 of the present embodiment, further preferably, the relation between the grinding wheel feeding speed Y (mm/min) and the partition wall thickness X (mm) of the cell partition walls 104 of the honeycomb structure 100 as the grinding object may be set to satisfy an upper limit of Equation (2) mentioned below. When conditions of Equation (2) are satisfied, the grinding process of the end face 101 can more suitably be performed:

$$Y \leq 76.5X - 1.18 \quad (2).$$

In the dry type grinding, as compared with wet type grinding, a mechanism which supplies a liquid such as water or a coolant is not required between the end face 101 and the grinding surface 111, and it is not necessary to installed large-sized equipment for liquid supply, or equipment to collect and treat a used liquid or to reutilize the liquid. Therefore, the device itself does not enlarge, and the end face grinding device 1 of the present embodiment can be made compact. In consequence, the end face grinding device can comparatively easily be disposed, and it is possible to realize preparation at low cost and miniaturization.

On the other hand, the dust collecting mechanism section 40 includes a suction pipe 41 connected to the hollow tubular spindle 22 of the grinding wheel reverse rotating mechanism section 20, and a dust collection storage portion 42 which is coupled with the suction pipe 41, decompresses insides of the spindle 22 and the suction pipe 41, and collects dust of the ground powder 102 between the end face 101 and the grinding surface 111 from a grinding surface 111 side to store the dust. Here, the other end **22*b* of the spindle extends through the grinding wheel supporting portion 21, and is opened in the cavity 112 of the grinding wheel 110 in the form of the cup. In consequence, the ground powder 102 on the grinding surface 111 side can be sucked via the other end 22*b* in a sucking direction V (see FIG. 1** or the like).

When the dust collecting mechanism section 40 is operated, the ground powder 102 between the end face 101 and the grinding surface 111 is sucked from the other end **22*b* of the spindle 22. When the ground powder 102 is removed from a space between the end face 101 and the grinding surface 111 is removed, the dry type grinding can suitably be performed. In the case of the wet type grinding, a liquid such as the coolant is supplied to the space between the end face 101 and the grinding surface 111. This liquid has an effect of washing the ground powder 102 generated as described above from the space between the end face 101 and the grinding surface 111. However, in the case of the dry type grinding, such an effect cannot be expected. Therefore, the end face grinding device 1 of the present embodiment includes the dust collecting mechanism section 40, and hence the ground powder 102 can be removed from the space between the end face 101 and the grinding surface 111**, and it is possible to stably perform the dry type grinding.

At this time, the suction and dust collection of the ground powder 102 are performed from the grinding surface 111 side of the grinding wheel 110. This is because, in a case where the suction of the ground powder 102 is performed from a surface on a side opposite to the grinding surface 111 (an end face 101 side of the honeycomb structure 100), there is a tendency that the ground powder 102 easily remains, the dry type grinding cannot stably be performed sometimes, and the chipping or the like based on the remaining ground powder 102 is easy to occur.

EXAMPLES

Hereinafter, an end face grinding device and an end face grinding method of the present invention will be described on the basis of the following examples, but the end face grinding device and the end face grinding method of the present invention are not limited to these examples.

(1) Evaluation Standards

The above end face grinding device was used, an end face of a honeycomb structure was ground and processed on various conditions, the processed end face of the honeycomb structure was visually confirmed, and evaluation of each end face was carried out. For specific evaluation standards, presence/absence and degrees of chippings of cell partition walls in the end face were confirmed, the number of the chippings in the end face (a total number of the chippings) and the number of the chippings per unit area (a chipping density) were counted and calculated, and the evaluation was carried out on the basis of predetermined evaluation standards (see Table 1). "The chipping" is defined as the chipping of the cell partition walls at a depth of 0.5 mm or more in the present description. Here, a honeycomb structure having a diameter of 103 mm (standard) was evaluated and judged as "A" when the total number of the chippings was 20 or less, evaluated and judged as "B" when the total number of the chippings was 21 or more and 40 or less, and evaluated and judged as "C" when the total number of the chippings was 41 or more. Additionally, a honeycomb structure having a diameter of 150 mm was evaluated and judged as "A" when the total number of the chippings was 42 or less, evaluated and judged as "B" when the total number of the chippings was 43 or more and 85 or less, and evaluated and judged as "C" when the total number of the chippings was 86 or more, and furthermore, a honeycomb structure having a diameter of 90 mm was evaluated and judged as "A" when the total number of the chippings was 15 or less, evaluated and judged as "B" when the total number of the chippings was 16 or more and 31 or less, and evaluated and judged as "C" when the total number of the chippings was 32 or more. In the case of the above A evaluation, the chipping density was 0.24 chippings/$cm^2$ or less, in the B evaluation, the chipping density was 0.48 chipping/$cm^2$ or less, and in the C evaluation, the chipping density was in excess of 0.48 chipping/$cm^2$. Here, "A" indicates a honeycomb structure of a suitable quality, "B" indicates a honeycomb structure of a quality which does not have any practical problems, and "C" indicates a non-conforming honeycomb structure.

TABLE 1

| | | Total No. of chippings Chippings/end face | | |
|---|---|---|---|---|
| Evaluation Standard | Chipping density Chippings/$cm^2$ | φ103 mm (standard) | φ150 mm | φ90 mm |
| A | 0.24 or less | 20 or less | 42 or less | 15 or less |
| B | in excess of 0.24 and 0.48 or less | 21 to 40 | 43 to 85 | 16 to 31 |
| C | in excess of 0.48 | 41 or more | 86 or more | 32 or more |

(Note)
A chipping of cell partition walls at a depth of 0.5 mm or more is defined as the chipping.

(2) End Face Grinding Method

Grinding processing of an end face of a honeycomb structure is based on an end face grinding method of the present invention. Specifically, an end face as a grinding object of a pillar-shaped honeycomb structure is directed upward, and the honeycomb structure is mounted on a structure fixing surface of a rotating portion of a structure rotating mechanism section. Further, the honeycomb structure is firmly fixed by using a structure holding portion so that a center of the end face of the honeycomb structure matches a rotation axis A1 of a rotating portion.

In consequence, during rotation, the honeycomb structure does not move along the structure fixing surface, or does not fall from a standing manner. Afterward, the structure rotating mechanism section is controlled via an operation control section, and the honeycomb structure is rotated along the rotation axis A1 (a structure rotating step). On the other hand, a grinding wheel reverse rotating mechanism section is controlled via the operation control section, and a grinding wheel supported by a grinding wheel supporting portion is rotated along a rotation axis A2 (a grinding wheel reverse rotating step). At this time, the grinding wheel rotates in a reverse rotating direction R2 to a rotating direction R1 of the honeycomb structure. Additionally, the grinding wheel is positioned on an upper side than the end face of the honeycomb structure.

In a state where both the honeycomb structure and the grinding wheel are rotated, a dry type grinding mechanism section is controlled via the operation control section. In consequence, a sliding portion main body supported by a sliding supporting portion slides from the upper side to a lower side. As a result, the grinding wheel of the grinding wheel reverse rotating mechanism section which is attached to the sliding portion main body gradually lowers while rotating, and a grinding surface of the grinding wheel comes close to the end face of the honeycomb structure. Finally, the end face comes in contact with the grinding surface, and hence the end face is gradually removed (a dry type grinding step). Simultaneously with the control of the dry type grinding mechanism section, control of a dust collecting mechanism section is started, and ground powder between the end face and the grinding surface is sucked on a grinding surface side through the other end of a rotating spindle (a dust collecting step).

The grinding is completed up to a predetermined grinding depth, a lifting portion main body is slid upward, and then, the rotations of the honeycomb structure and the grinding wheel are stopped. Afterward, the honeycomb structure held by sandwiching the honeycomb structure between fixing chucks of the structure holding portion is released, and the honeycomb structure is removed from the mounting fixing surface. In consequence, the grinding process of the end face of the honeycomb structure is completed.

(3) Types of Grindstone and Bonding Agent for Use

As the grinding wheel for use in the above end face grinding method, a heretofore well-known grinding wheel can suitably be utilized. For example, as abrasive grains, a cemented material such as diamond or CBN (cubic boron nitride) is usable, and as a bonding agent to bond these abrasive grains to a grinding wheel base, various bonding agents such as a well-known resin based bonding agent, a metal based bonding agent, a resin-metal based bonding agent and a vitrified bonding agent are usable. There is not any special restriction on the grinding wheel (the abrasive grains) and the bonding agent for use, and they can suitably be selected. For example, when a partition wall thickness is 0.15 mm (6 mil) or more, the grinding wheel having a roughness of count of #120 is usable. Hereinafter, as the partition wall thickness decreases (e.g., 0.15 mm (6 mil) to 0.05 mm (2 mil)), a grinding wheel of much smaller count (e.g., #400 or the like) is usable.

(4) Evaluation of Influence by Rotations of Grindstone and Honeycomb Structure

Comparison was carried out between a case where to a honeycomb structure in which a honeycomb diameter: 150 mm, a partition wall thickness: 0.11 mm (4.5 mil) and a cell density: 62 cells/cm$^2$ (400 cpsi), a grinding wheel was rotated in a reverse rotating direction to a rotating direction of the honeycomb structure on grinding process conditions of a grinding wheel feeding speed Y: 8 mm/min and a grinding wheel rotating speed (a peripheral speed): 6000 rpm (47 m/s) (Example 1) and a case where a honeycomb structure was rotated in the same rotating direction as in a grinding wheel (Comparative Example 1). According to this comparison, in the case of Example 1, the total number of chippings in a ground and processed end face and a chipping density had A evaluation, whereas in the case of Comparative Example 1, C evaluation was obtained (see Table 2). That is, it has been confirmed that the grinding process of the end face can suitably be performed by rotating the grinding wheel in the reverse direction to the rotation of the honeycomb structure. Additionally, the following examples and comparative examples were evaluated by uniformly rotating the grinding wheel in the reverse direction to the rotation of the honeycomb structure. Here, 1 mil is a unit indicating 1/1000 inch, and cpsi indicates the number of the cells per square inch.

TABLE 2

| | Example 1 | Comparative Example 1 |
|---|---|---|
| Honeycomb dia. | φ150 mm | |
| Partition wall thickness | 0.11 mm (4.5 mil) | |
| Cell density | 62 cells/cm$^2$ (400 cpsi) | |
| Grindstone feeding speed | 8 mm/min | |
| Grindstone rotating speed (peripheral speed) | 6000 rpm (47 m/s) | |
| Rotating direction | Reverse direction to that of grinding wheel | Matching the direction of the grinding wheel |
| Evaluation | A | C |

(5) Evaluation of Rotating Speed of Honeycomb Structure

Next, there will be described evaluation of an end face in a case where a rotating speed of a honeycomb structure is changed (Examples 1 to 6 and Comparative Examples 2 to 5). Here, for a honeycomb structure in which a honeycomb diameter: 150 mm, a partition wall thickness: 0.11 mm (4.5 mil) and a cell density: 62 cells/cm$^2$ (400 cpsi), a grinding wheel feeding speed was set to 8 mm/min, and for a honeycomb structure in which a honeycomb diameter: 90 mm, a partition wall thickness: 0.06 mm (2.5 mil) and a cell density: 140 cells/cm$^2$ (900 cpsi), a grinding wheel feeding speed was set to 4 mm/min to perform grinding process. Here, a rotating speed (a peripheral speed) of a grinding wheel was 6000 rpm (47 m/s) on any conditions. Further, the rotating speeds of the honeycomb structures were changed to 5 rpm (Comparative Examples 3 and 5), 40 rpm (Comparative Examples 2 and 4), 50 rpm (Examples 3 and 6), 83 rpm (Examples 2 and 5) and 150 rpm (Examples 1 and 4), respectively. Table 3 shows the results as follows.

TABLE 3

| | Example 1 | Example 2 | Example 3 | Example 4 | Example 5 | Example 6 | Comparative Example 2 | Comparative Example 3 | Comparative Example 4 | Comparative Example 5 |
|---|---|---|---|---|---|---|---|---|---|---|
| Honeycomb dia. | φ150 mm | | | φ90 mm | | | φ150 mm | | φ90 mm | |
| Partition wall thickness | 0.11 mm (4.5 mil) | | | 0.06 mm (2.5 mil) | | | 0.11 mm (4.5 mil) | | 0.06 mm (2.5 mil) | |
| Cell density | 62 cells/cm$^2$ (400 cpsi) | | | 140 cells/cm$^2$ (900 cpsi) | | | 62 cells/cm$^2$ (400 cpsi) | | 140 cells/cm$^2$ (900 cpsi) | |
| Rotating speed of grinding wheel (peripheral speed) | 6000 rpm (47 m/s) | | | | | | 6000 rpm (47 m/s) | | | |
| Grindstone feeding speed | 8 mm/min | | | 4 mm/min | | | 8 mm/min | | 4 mm/min | |
| Rotating speed of honeycomb structure | 150 rpm | 83 rpm | 50 rpm | 150 rpm | 83 rpm | 50 rpm | 40 rpm | 5 rpm | 40 rpm | 5 rpm |
| Evaluation | A | A | B | A | A | B | C | C | C | C |

According to this table, in cases where the rotating speeds of the honeycomb structures were 5 rpm and 40 rpm (Comparative Examples 2 to 5), C evaluation was obtained. That is, in a case where the rotating speed of the honeycomb structure is slow, chippings are easy to occur. On the other hand, in cases where the rotating speeds of the honeycomb structures were 50 rpm (Examples 3 and 6), B evaluation was obtained, and in cases where the rotating speeds of the honeycomb structures were 83 rpm or more (Examples 1, 2, 4 and 5), A evaluation was obtained. That is, in a case where the rotating speed of the honeycomb structure is at least 50 rpm or more and more preferably 83 rpm or more, the grinding process can suitably be performed without generating any chippings in the end face.

(6) Evaluation of Rotating Speed (Peripheral Speed) of Grindstone

Next, there will be described evaluation of an end face in a case where a rotating speed of a grinding wheel was changed (Examples 1, 4, 7 and 8 and Comparative Examples 6 and 7). Additionally, a honeycomb diameter of a honeycomb structure and a grinding wheel feeding speed Y were set in the same manner as in the above (5), and a rotating speed of the honeycomb structure was set to 150 rpm. Furthermore, the rotating speeds of the grinding wheels were changed to 4000 rpm (31 m/s: Comparative Examples 6 and 7), 6000 rpm (47 m/s, Examples 1 and 4) and 7460 rpm (60 m/s: Examples 7 and 8), respectively (Table 4). Table 4 shows the results as follows.

TABLE 4

| | Example 1 | Example 7 | Example 4 | Example 8 | Comparative Example 6 | Comparative Example 7 |
|---|---|---|---|---|---|---|
| Honeycomb dia. | φ150 mm | | φ90 mm | | φ150 mm | φ90 mm |
| Partition wall thickness | 0.11 mm (4.5 mil) | | 0.06 mm (2.5 mil) | | 0.11 mm (4.5 mil) | 0.06 mm (2.5 mil) |
| Cell density | 62 cells/cm$^2$ (400 cpsi) | | 140 cells/cm$^2$ (900 cpsi) | | 62 cells/cm$^2$ (400 cpsi) | 140 cells/cm$^2$ (900 cpsi) |
| Rotating speed of honeycomb structure | 150 rpm | | | | 150 rpm | |
| Grindstone feeding speed (partition wall thickness) | 8 mm/min | | 4 mm/min | | 8 mm/min | 4 mm/min |
| Rotating speed of grinding stone (peripheral speed) | 6000 rpm (47 m/s) | 7460 rpm (60 m/s) | 6000 rpm (47 m/s) | 7460 rpm (60 m/s) | 4000 rpm (31 m/s) | |
| Evaluation | A | A | A | A | C | C |

According to this table, in cases where the rotating speed (the peripheral speed) of the grinding wheel was 4000 rpm (Comparative Examples 6 and 7), C evaluation was obtained. That is, in a case where the rotating speed of the grinding wheel is slow, chippings are easy to occur. On the other hand, in a case where the rotating speed of the grinding wheel was 6000 rpm or more (Examples 1, 4, 7 and 8), A evaluation was obtained. In consequence, when the rotating speed of the grinding wheel is at least 6000 rpm or more and more preferably 7460 rpm, grinding process can suitably be performed without causing any chippings in the end face.

(7) Evaluation of Relation Between Grindstone Feeding Speed and Partition Wall Thickness For a plurality of honeycomb structures which were difference in honeycomb diameter and partition wall thickness X, a grinding wheel feeding speed Y was changed to perform grinding process of an end face. Here, a rotating speed of the honeycomb structure was set to 150 rpm and a rotating speed of a grinding wheel was set to 6000 rpm (47 m/s). Further specifically, for a honeycomb structure in which a honeycomb diameter was 150 mm, there were prepared four types of samples in which the partition wall thickness X was 0.2 mm (8 mil), 0.15 mm (6 mil), 0.11 mm (4.5 mil) and 0.09 mm (3.5 mil). On the other hand, for a honeycomb structure in which a honeycomb diameter was 90 mm, there were prepared two types of samples in which partition wall thicknesses X were 0.06 mm (2.5 mil) and 0.05 mm (2.0 mil). As to these six types of samples of the honeycomb structure in total, the grinding wheel feeding speed Y was changed to perform the grinding process of the end face. Table 5 shows the results as follows. It is to be noted that in Table 5, "-" indicates an unverified result.

TABLE 5

| Honeycomb dia. | | φ150 mm | | | φ90 mm | | |
|---|---|---|---|---|---|---|---|
| Partition wall thickness (X) | | 0.2 mm (8 mil) | 0.15 mm (6 mil) | 0.11 mm (4.5 mil) | 0.09 mm (3.5 mil) | 0.06 mm (2.5 mil) | 0.05 mm (2.0 mil) |
| Cell density | | 47 cells/cm$^2$ (300 cpi) | 62 cells/cm$^2$ (400 cpsi) | | 62 cells/cm$^2$ (400 cpsi) | 140 cells/cm$^2$ (900 cpsi) | 93 cells/cm$^2$ (600 cpsi) |
| Rotating speed of honeycomb structure | | 150 rpm | | | | | |
| Rotating speed (peripheral speed) of grinding wheel | | 6000 rpm (47 m/s) | | | | | |
| Grindstone feeding speed (Y) | 15 mm/min | Example 9 A | Example 11 B | Comparative Example 8 C | — | — | — |
| | 10 mm/min | Example 10 A | Example 12 A | Example 14 B | Comparative Example 9 C | — | — |
| | 8 mm/min | — | Example 13 A | Example 1 A | Example 16 B | Comparative Example 10 C | — |
| | 6 mm/min | — | — | Example 15 A | Example 17 A | Example 19 B | Comparative Example 11 C |
| | 4 mm/min | — | — | — | Example 18 A | Example 4 A | Example 21 B |
| | 2 mm/min | — | — | — | — | Example 20 A | Example 22 A |
| | 1 mm/min | — | — | — | — | — | Example 23 A |

According to this table, in a case where a partition wall thickness X was large (e.g., 0.2 mm (8 mil) and 0.15 mm (6 mil)), even when the grinding wheel feeding speed Y was comparatively fast at 15 mm/min, 10 mm/min or the like, a ground and processed end face had A evaluation or B evaluation (Examples 9 to 12). That is, in a case where the partition wall thickness X is large at 0.15 mm (6 mil) or more, even when a grinding wheel comes in contact with the end face at a high speed, there is the decreased possibility that chipping occurs by shock due to the contact. When the grinding wheel feeding speed Y increases, processing time to reach a predetermined grinding depth H shortens. Therefore, the grinding wheel feeding speed Y is set to a speed as fast as possible, grinding process time of the end face of one honeycomb structure can be shortened, and grinding process can efficiently be performed. However, in each of a case where the grinding wheel feeding speed Y was 15 mm/min and the partition wall thickness X was 0.11 mm (4.5 mil) (Comparative Example 8) and a case where the grinding wheel feeding speed Y was 10 mm/min and the partition wall thickness X was 0.09 mm (3.5 mil) (Comparative Example 9), C evaluation was obtained. Therefore, in a case where the partition wall thickness is smaller than the above values, it is difficult to suitably perform the grinding process.

In a case where the partition wall thickness X was an intermediate degree (0.11 mm (4.5 mil) or 0.09 mm (3.5 mil)), when the grinding wheel feeding speed Y was lower than an intermediate speed of 10 mm/min or less (Examples 1 and 14 to 18, but the case of Comparative Example 9 mentioned above was excluded), the ground and processed end face had A evaluation or B evaluation. That is, as compared with a case where the partition wall thickness X is large (0.15 mm (6 mil) or the like), to suitably perform the grinding process of the end face, it is necessary to suppress the grinding wheel feeding speed Y to a low speed.

On the other hand, in a case where the partition wall thickness X was especially small (e.g., 0.06 mm (2.5 mil) or 0.05 mm (2.0 mil), when the grinding wheel feeding speed Y was a low speed of 6 mm/min or less (Examples 4 and 19 to 23, but the case of Comparative Example 11 was excluded) or the like, the ground and processed end face had A evaluation or B evaluation. That is, as compared with a case where the partition wall thickness X is large or an intermediate degree, to suitably perform the grinding process of the end face, it is necessary to further suppress the grinding wheel feeding speed Y to a low speed of 6 mm/min or less. As a result, there is a tendency that grinding process time of the end face of one honeycomb structure lengthens.

It has been confirmed from the results of Table 5 that to receive the B evaluation or more, the relation between the grinding wheel feeding speed Y and the partition wall thickness X needs to satisfy the conditions of Equation (1) mentioned above, and further to receive the A evaluation, the relation between the grinding wheel feeding speed Y and the partition wall thickness X needs to satisfy the conditions of Equation (2) mentioned above.

As described above, according to the end face grinding device and the end face grinding method of the present embodiment, the grinding wheel is rotated in the reverse direction to the rotation of the honeycomb structure, the rotation of the honeycomb structure is set to at least 50 rpm or more, the rotating speed of the grinding wheel is set to at least 6000 rpm or more, and further, the relation between the grinding wheel feeding speed and the partition wall thickness satisfies the conditions of Equation (1) or (2) mentioned above, so that the end face grinding process can suitably efficiently be performed. Furthermore, the end face grinding device of the present embodiment includes the dust collecting mechanism section, and hence the end face grinding process can stably be performed without leaving any ground powder between the end face and the grinding surface even in the dry type grinding.

The present invention has been described on the basis of the above embodiments and examples, but the present invention is not limited to these embodiments or examples. For example, it has been described that the grinding wheel is slid to the rotating honeycomb structure from the upside to come close to the end face, but the present invention is not limited to this example. That is, the sliding direction of the grinding wheel and the sliding portion main body is not limited to the upward to downward direction, and the grinding wheel and the sliding portion main body may slide, e.g., from the downside to the upside or in a horizontal direction. There is not any special restriction on the sliding direction, as long as the sliding direction matches a direction orthogonal to the end face held by the rotating portion and the grinding surface of the grinding wheel is disposed to face the end face.

Furthermore, it has been described that in the end face grinding device of the present embodiment, the dust collecting mechanism section is disposed and the ground powder is collected during the dry type grinding, but the present invention is not limited to this example. That is, the operation may be stopped in accordance with various grinding process conditions, or the constitution of the dust collecting mechanism section may be omitted. For example, in a case where the grinding wheel is slid to the end face of the honeycomb structure in the horizontal direction, most of the ground powder generated by the dry type grinding drops down in accordance with gravity, and the ground powder hardly remains between the end face and the grinding surface. In such cases, the constitution of the dust collecting mechanism section can be omitted.

An end face grinding method and an end face grinding device of the present invention can be utilized to adjust end faces of a honeycomb structure when the honeycomb structure is manufactured.

DESCRIPTION OF REFERENCE NUMERALS

1: end face grinding device, 10: structure rotating mechanism section, 11: structure supporting portion, 12: structure fixing surface, 13: rotating portion, 14: structure rotating substrate, 15: structure driving portion, 16: structure holding portion, 17*a* and 17*b*: fixing chuck, 18: moving groove, 20: grinding wheel reverse rotating mechanism section, 21: grinding wheel supporting portion, 22: spindle, 22*a*; one end of the spindle, 22*b*: the other end of the spindle, 23: grinding wheel rotating substrate, 24: grinding wheel driving portion, 30: dry type grinding mechanism section, 31: sliding supporting portion, 32: sliding portion main body, 33: ball screw, 34: sliding driving portion, 35: sliding rail, 40: dust collecting mechanism section, 41: suction pipe, 42: dust collection storage portion, 50: common base, 51: operation control section, 100: honeycomb structure, 101: end face, 102: ground powder, 103: circumferential side surface, 104: cell partition wall, 105: cell, 110: grinding wheel, 111: grinding surface, 112: cavity, A1 and A2: rotation axis, G: installation surface, H: grinding depth, L: holding direction, R1: rotating direction, R2: reverse rotating direction, V: sucking direction, X: partition wall thickness, Y: grinding wheel feeding speed, and Z: grinding wheel feeding direction.

What is claimed is:

1. An end face grinding method to perform dry type grinding of an end face of a ceramic honeycomb structure, comprising:

a structure rotating step of rotating the honeycomb structure in a first rotational direction based on a rotation axis in a direction orthogonal to the end face;

a grinding wheel reverse rotating step of using a grinding wheel disposed so that a grinding surface faces the end face and rotating the grinding wheel in a second rotational direction opposite the first rotational direction of the honeycomb structure based on a rotation axis in the direction orthogonal to the end face; and a dry type grinding step of bringing the grinding wheel rotating in the second rotational direction close to the rotating honeycomb structure to perform the dry type grinding of the end face;

wherein one of the first rotational direction and the second rotational direction is a counter-clockwise direction.

2. The end face grinding method according to claim 1, further comprising:

a dust collecting step of sucking, from the side of the grinding surface of the grinding wheel, ground powder of the honeycomb structure which is generated by the dry type grinding step to collect dust.

3. The end face grinding method according to claim 2, wherein in the grinding wheel reverse rotating step, a hollow tubular spindle to rotate the grinding wheel is used, and in the dust collecting step, the ground powder is sucked from one end of the spindle which is opened to the grinding surface.

4. The end face grinding method according to claim 1, wherein the honeycomb structure comprises a plurality of polygonal cells defined by latticed cell partition walls, and a relation between a grinding wheel feeding speed Y (mm/min) of the grinding wheel to the honeycomb structure in the dry type grinding step and a partition wall thickness X (mm) of the cell partition walls satisfies conditions of $Y \leq 114.7X-1.78$.

5. The end face grinding method according to claim 1, wherein a peripheral speed of the grinding wheel in the grinding wheel reverse rotating step is 35 m/s or more.

6. The end face grinding method according to claim 1, wherein a rotating speed of the honeycomb structure in the structure rotating step is 50 rpm or more and 600 rpm or less.

7. The end face grinding method according to claim 1, wherein a grinding depth of the end face of the honeycomb structure in the dry type grinding step is from 0.5 to 1.0 mm.

8. An end face grinding device to perform dry type grinding of an end face of a ceramic honeycomb structure by use of the end face grinding method according to claim 1, comprising:

a structure rotating mechanism section which has a rotating portion comprising a structure holding portion holding the honeycomb structure and which rotates the honeycomb structure based on a rotation axis in the first rotational direction orthogonal to the end face;

a grinding wheel reverse rotating mechanism section which has a grinding wheel supporting portion supporting a grinding wheel whose grinding surface is disposed to face the end face and which rotates the grinding wheel in the second rotational direction opposite to the first rotational direction of the honeycomb structure based on a rotation axis in a direction orthogonal to the end face and the grinding surface; and a dry type grinding mechanism section which brings the grinding wheel rotating in the second rotational direction close to the rotating honeycomb structure to perform the dry type grinding step of the end face, wherein one of the first rotational direction and the second rotational direction is a counter-clockwise direction.

9. The end face grinding device according to claim 8, further comprising:

a dust collecting mechanism section which sucks, from the side of the grinding surface, ground powder of the honeycomb structure which is generated by the dry type grinding of the end face, to collect dust.

10. The end face grinding device according to claim 9, wherein the grinding wheel reverse rotating mechanism section further comprises a hollow tubular spindle connected to the grinding wheel supporting portion to rotate the grinding wheel, and the dust collecting mechanism section sucks the ground powder from one end of the spindle which is opened to the grinding surface side, to collect the dust.

* * * * *